US005109635A

United States Patent [19]

Inzerillo et al.

[11] Patent Number: 5,109,635

[45] Date of Patent: May 5, 1992

[54] METHOD FOR MANUFACTURING WATCH DIALS OF MURRINO GLASS AND DIALS OBTAINED WITH THIS METHOD

[76] Inventors: Giuseppe Inzerillo, S. Polo, 1949/A; Franco Nordio, Cannaregio, 2656, both of Venezia, Italy

[21] Appl. No.: 536,151

[22] Filed: Jun. 7, 1990

[30] Foreign Application Priority Data

Jun. 12, 1989 [IT] Italy ..... 85607 A/89

[51] Int. Cl.[5] ..... B24B 1/00

[52] U.S. Cl. ..... 51/283 R; 51/283 E; 51/281 SF; 51/323; 51/326; 368/232; 368/234

[58] Field of Search ..... 51/326, 323, 56 R, 284 R, 51/284 E, 283 R, 283 E, 328, 281 R, 281 SF; 29/177; 368/232, 228, 234

[56] References Cited

U.S. PATENT DOCUMENTS

| | | | |
|---|---|---|---|
| 744,355 | 11/1903 | Kanstoroom | 368/232 |
| 2,196,998 | 4/1940 | Lodge | 29/177 |
| 3,123,953 | 3/1964 | Merkl | 51/283 |
| 3,488,895 | 1/1970 | Thompson | 51/283 R |
| 3,583,110 | 6/1971 | Scott | 51/283 R |
| 3,673,746 | 7/1972 | Highberg | 51/283 |
| 3,793,824 | 2/1974 | Simon-Vermot et al. | 368/232 |
| 4,964,239 | 10/1990 | Gottschald et al. | 51/284 E X |

FOREIGN PATENT DOCUMENTS

| | | | |
|---|---|---|---|
| 2225879 | 6/1990 | United Kingdom | 368/232 |

*Primary Examiner*—D. S. Meislin

*Attorney, Agent, or Firm*—Birch, Stewart, Kolasch & Birch

[57] ABSTRACT

A method for manufacturing a glass watch dial made of "murrino" glass, said method comprising a phase for the axial drilling of the "murrina" disc, the hole resulting therefrom having a diameter to allow the passage of the watch-hand supporting shaft therethrough, one or more honing phases whereby the two surfaces of the "murrina" disc aare made to become parallel to each other, while the disc itself acquires a thickness which is compatible with its use as a watch dial, a phase for trimming of the outer edge of the "murrina" disc and a phase for polishing at least one of the two visible surfaces of the "murrina". The method achieves the manufacturing of watch dials by using "murrinas", i.e., objects constituted by a plurality of small glass cylinders melted together to form desired patterns.

7 Claims, 1 Drawing Sheet

METHOD FOR MANUFACTURING WATCH DIALS OF MURRINO GLASS AND DIALS OBTAINED WITH THIS METHOD

BACKGROUND AND SUMMARY OF THE INVENTION

The present invention concerns a method for manufacturing watch dials obtained by processing "murrino" glass.

It is known that "murrino" glass or "murrina" is a glass product obtained by melting a plurality of small glass cylinders having a length of 5-6 mm and a diameter of 3-4 mm, placed next to each other, usually presenting different colour and arranged so as to form a pre-determined pattern. The small cylinders, arranged so as to form a pre-determined pattern are then melted in a glass-melting oven and the product resulting therefrom is called "murrina".

The "murrinas" as known at the present time are used essentially as pendants for necklaces or as medallions and they are usually round objects. The thickness which in the known technique measures 5-6 mm cannot be reduced because of the danger of breaking the murrina when further reducing its thickness with known techniques applied in the processing of artistic glass.

This limitation, i.e. the present impossibility of obtaining a thin thicknesses of "murrinas" has prevented the realization of a dial for watches obtained from a "murrina", since a dial with a thickness of 5-6 mm. could not be obtained, if one considers that this is the required thickness of a complete watch dial.

The present invention proposes a method for manufacturing watch dials using "murrino" glass, whereby the above mentioned inconveniences can be overcome.

More specifically, the purpose of the present invention is to provide a manufacturing method, whereby it is possible to produce watch dials of "murrino" glass having a thickness of about 1 mm or less, for example about 0.8 mm, without any danger of breaking the "murrino" glass, while obtaining smooth surfaces which are parallel to each other. The watch dials do not prevent the free rotation of the watch hands and do not impede the movement of the watch works on the underside of the dial. All of the above-mentioned purposes, which are better explained hereinafter, can be obtained by the method for manufacturing dials obtained by processing ∓murrino" glass, said type of glass consisting of a disc having considerable thickness. The glass is obtained by melting a plurality of small glass cylinders arranged one next to the other so as to form a pattern, wherein said method is characterized in that is comprises:

a phase of axial drilling of the "murrina" disc in order to obtain a hole having such a diameter as to allow the passage of the hand-supporting shaft therethrough;

one or more honing phases on the two surfaces of the "murrina" disc, to obtain a reduction in thickness in accordance with the intended use of the disc as a watch dial with two flat surfaces which are parallel to each other;

a phase for trimming the outer edge of the "murrina", so as to obtain a desired outer perimeter and;

a subsequent phase for polishing at least one of the two visible surfaces of the "murrina".

Advantageously according to the present invention, after the "murrina" disc has been axially drilled, the most delicate phase is undertaken where it consists of honing the surfaces of the "murrina", so as to obtain two flat and smooth surfaces which are parallel to each other and a thin thickness which is compatible with the use of the disc as a watch dial. The honing process is performed in at least two phases by means of a machine having a honing disc and a support for anchoring the "murrina". The support on which the "murrina" is anchored is brought close to the rotating honing disc and, by performing a tangential alternate motion between the "murrina" and the honing disc a first honing of one "murrina" surface and a first reduction of its thickness are obtained. When the thickness of the "murrina" is about twice the final desired thickness, the "murrina" is removed from the support which holds it on the machine head and it is turned downside up, so that it can be placed in the support with the already honed surface facing up and the surface to be honed turned face down toward the honing disc.

The fixed connection between the "murrina" and its support is obtained by means of a special bonding agent resisting to temperatures of up to 150° to 250° degrees C. When the "murrina" needs to be detached from its support, the bonding agent is heated and the "murrina" will come off the support.

Once the thickness has been thus reduced to a size which is compatible with the thickness of dials that can be used in normal wrist watches, the outer edge of the "murrina" disc will be trimmed and it can retain its round shape or acquire a square or rectangular or even any other shape.

Finally at least one of the two visible surfaces will be polished. Further scope of applicability of the present invention will become apparent from the detailed description given hereinafter. However, it should be understood that the detailed description and the specific example, while indicating a preferred embodiment of the invention, are given by way of illustration only, since various changes and modifications within the spirit and scope of the invention will become apparent to those skilled in the art from this detailed description, and from the drawings, wherein:

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

With reference to FIG. 1 it shows a disc made of "murrina" glass, indicated as element 1, presenting a pattern on its surface 2. Disc 1 has a thickness, indicated as 3, which ranges from 5 to 6 mm. This is why the disc will have to undergo a honing process, resulting in a reduction of its thickness, and a surface polishing process, so that it can be changed into a watch dial.

The first phase of the production method, according to the present invention, concerns the axial drilling of the "murrina" disk, said drilling being performed practically in the center, with known tools, so as to obtain a hole 4 having such dimensions as to allow an easy passage of the watch-hand supporting shaft.

Figure 1:
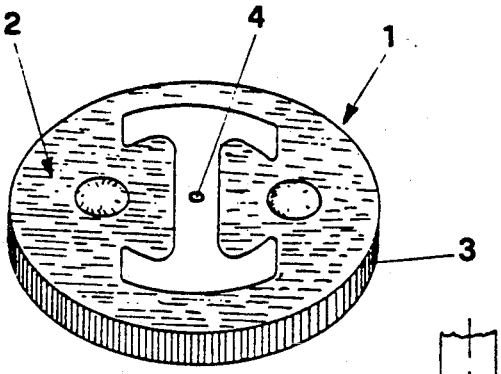
FIG. 1 shows a magnified "murrina" before it is tranformed into a watch dial.
Figure 2:
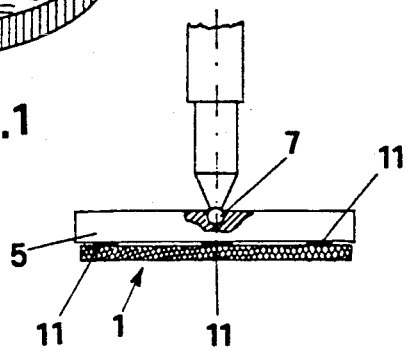
FIG. 2 shows the "murrina" support which is a component of the honing machine.
Figure 3:
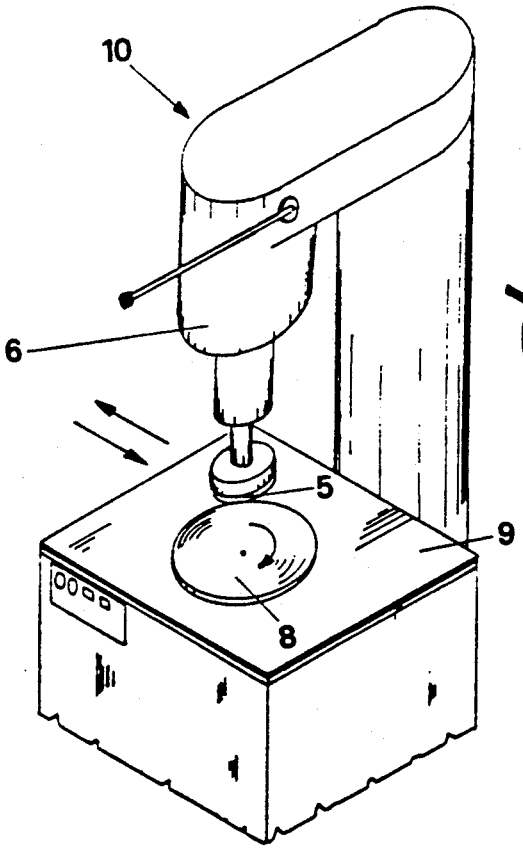
FIG. 3 shows the complete honing machine.

Once the drilling phase has been completed, the "murrina" disc 1 will have to undergo the honing of its surfaces and, at the same time, a reduction of its thickness 3. To this purpose disc 1 will be fixed on support 5 which consists essentially of a metal disc belonging to a honing machine, represented in FIG. 3 and indicated as element 10. The support is attached to head 6 of the honing machine 10 by means of a ball-and-socket joint 7 which allows the support 5 to rest against the honing disc 8 belonging to the work surface 9 of the machine, so that, when "murrina" 1 is pushed into contact with the honing disc 8, support 5, which can swing, grants the correct parallelism of the "murrina" surface in relation to the honing disc 8. The junction between "murrina" 1 and support 5 is obtained by means of a bonding agent, indicated by element 11, which is spread between the surface of the support 5 and the surface of the "murrina" which is in contact with said support.

The bonding agent is of the plastic type which hardens when exposed to the air and is resistant to high temperatures.

It is obvious that other types of bonding agents also fulfill the same purpose, which is the bonding together of support 5 and of the glass "murrina" 1, provided that they can easily be removed in order to allow the subsequent bonding of the honed surface to permit processing of the opposite surface.

Figure 4:
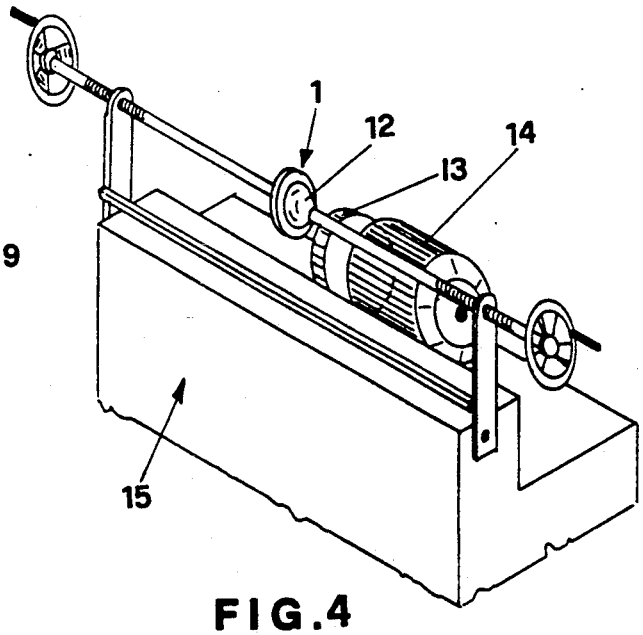
FIG. 4 shows a machine suited to trim the outer edge of the "murrina" disc.

After the desired thickness of the "murrina" has been obtained and also after it can safely be determined that its two faces are parallel to each other, it becomes necessary to trim the outer edge of the "murrina" DISC so as to obtain the desired dimensions of the dial. If the dial is to present a round shape, FIG. 4 shows that the glass "murrina" 1 with its thickness already reduced is placed between two tailstocks each complete with a suction cup 12, so that the edge can be worked on with a diamond tool 13. The tool 13 is driven by a motor 14 belonging to a tool machine, which is indicated by element 15, wherein the diamond tool 13 and "murrina" 1 can be reciprocally brought into contact. If the dial is to have a shape differing from the round one, the reciprocal contact between the "murrina" and the diamond tool will be controlled by a suitable template.

The last phase of the method for the production of the dial made from "murrina" is the polishing process of at least one of the two faces of the by now almost finished dial, which has already acquired its final dimensions.

The polishing process has the purpose of improving its aesthetical aspect and make it suitable to be used for the inteded purpose.

The "murrina" dial is polished with a cover made of foam polyurethane and impregnated with cerium-oxyde or an equivalent substance. The polishing process removes the opacity from the glass surface, which had previously been trated with an abrasive agent during the honing process, and yealds a high gloss.

With the present method it is possible to manufacture dials of "murrina" glass or, to be more specific, dials made of a plurality of small glass cylinders forming a pre-determined pattern, having a thickness and a shape which are suited to be used in a watch, e.g., a wrist watch, whereby the object obtained has a unique precious look.

The method proposed by the invention may be completed with intermediate working phases in order to improve the product thus obtained, said phases will, however not exceed the scope of the invention, such as claimed hereinafter.

We claim:

1. A method for the production of watch dials made of "murrina" glass having a considerable thickness and obtained by melting a plurality of small glass cylinders placed next to each other so as to form a pattern, said method comprising the steps of axially drilling a "murrina" disc with a hole having a diameter to allow the passage of a watch-hand supporting shaft therethrough;

conducting one or more honing phases in order to obtain two surfaces of the disc which are parallel to each and having a thickness for use as a dial for a watch;

the outer edge of the "murrina" disc to obtain a desired outer perimeter; and further polishing at least one of the two visible surfaces of the "murrina".

2. The method according to claim 1, wherein the trimming of the outer edge of the "murrina" disc is a turning process performed with a diamond disc or tool according to a pre-determined diameter.

3. The method according to claim 1, wherein the trimming of the outer edge of the "murrina" disc is a turning process performed with a diamond disc or tool, which follows the shape of a template.

4. The method of claim 1 wherein during the honing phase the murrina disc is mounted on a support which in turn is pivotally attached to a honing machine and the murrina disc is pressed by the support against an abrasive honing disc to effect parallelism of the murrina surfaces.

5. A method according to claim 4, wherein a binding agent is disposed between the "murrina" disc and the support for bonding the disc to the support.

6. A method according to claim 4 wherein the pivotal attachment is a ball-and-socket joint which enables the support containing the murrina disc to move in parallelism with the honing disc.

7. The method according to claim 1, wherein the polishing process is performed by polishing rollers, covered with polyurethane foam impregnated with cerium oxide.

* * * * *